US009341176B2

(12) United States Patent
Itahara

(10) Patent No.: US 9,341,176 B2
(45) Date of Patent: May 17, 2016

(54) DIAPHRAGM PUMP

(75) Inventor: Kazuki Itahara, Tokyo (JP)

(73) Assignee: OKENSEIKO CO., LTD., Tokyo (JP)

( * ) Notice: Subject to any disclaimer, the term of this patent is extended or adjusted under 35 U.S.C. 154(b) by 238 days.

(21) Appl. No.: 13/564,589

(22) Filed: Aug. 1, 2012

(65) Prior Publication Data

US 2013/0034452 A1 Feb. 7, 2013

(30) Foreign Application Priority Data

Aug. 4, 2011 (JP) ..... 170730/2011
Aug. 4, 2011 (JP) ..... 170731/2011

(51) Int. Cl.

| | |
|---|---|
| ***F04B 45/04*** | (2006.01) |
| ***F04B 45/047*** | (2006.01) |
| ***F04B 43/02*** | (2006.01) |
| ***F04B 43/04*** | (2006.01) |
| ***F04B 53/22*** | (2006.01) |

(52) U.S. Cl.

CPC ..... *F04B 45/04* (2013.01); *F04B 43/02* (2013.01); *F04B 43/04* (2013.01); *F04B 45/047* (2013.01); *F04B 53/22* (2013.01)

(58) Field of Classification Search

CPC ..... F04B 53/22; F04B 45/047; F04B 39/14; F04B 17/03; F04B 43/021; F04B 43/04; F04B 45/04

USPC ..... 417/413.1, 269, 360, 363; 310/154.01, 310/154.03, 154.04, 154.05, 154.16

See application file for complete search history.

(56) References Cited

U.S. PATENT DOCUMENTS

| | | | | | |
|---|---|---|---|---|---|
| 3,089,424 | A | * | 5/1963 | Smith | 418/53 |
| 4,153,391 | A | * | 5/1979 | Hartley | 417/269 |
| 4,486,151 | A | * | 12/1984 | Korhonen-Wesala | 417/222.1 |
| 4,610,605 | A | * | 9/1986 | Hartley | 417/269 |
| 4,801,249 | A | * | 1/1989 | Kakizawa | 417/269 |
| 5,261,792 | A | * | 11/1993 | Schoenmeyr | 417/38 |
| 5,476,367 | A | * | 12/1995 | Zimmermann et al. | 417/307 |
| 5,481,148 | A | * | 1/1996 | Moribayashi et al. | 310/154.16 |

(Continued)

FOREIGN PATENT DOCUMENTS

| | | | |
|---|---|---|---|
| CN | 101100989 | A | 7/2007 |
| CN | 101349263 | A | 7/2008 |

(Continued)

OTHER PUBLICATIONS

Japanese Office Action dated May 26, 2015, 4 pages.

*Primary Examiner* — Alexander Comley
(74) *Attorney, Agent, or Firm* — Blakely Sokoloff Taylor & Zafman LLP

(57) ABSTRACT

A diaphragm pump includes a motor having a recess in an outer circumferential portion, a crank which rotates together with a motor output shaft, a driving member including a driving element which reciprocates in accordance with the crank rotation, and a diaphragm which forms a pump chamber which expands and contracts in accordance with the reciprocating driving element. The pump also includes a suction passage which draws a fluid into the pump chamber, a discharge passage which discharges the fluid, a suction valve formed in the suction passage to regulate a reverse flow of the fluid to the suction passage, a discharge valve formed in the discharge passage to regulate a reverse flow of the fluid to the pump chamber, and an elastically deformable cylindrical member which holds the diaphragm and includes a projection which engages with the recess of the motor.

5 Claims, 8 Drawing Sheets

(56) References Cited

U.S. PATENT DOCUMENTS

| | | | | |
|---|---|---|---|---|
| 5,540,556 | A * | 7/1996 | Du | 417/44.8 |
| 5,626,464 | A * | 5/1997 | Schoenmeyr et al. | 417/269 |
| 5,632,607 | A * | 5/1997 | Popescu et al. | 417/415 |
| 5,791,882 | A * | 8/1998 | Stucker et al. | 417/269 |
| 6,299,414 | B1 * | 10/2001 | Schoenmeyr | 417/244 |
| 6,715,994 | B2 * | 4/2004 | Patel et al. | 417/12 |
| 2006/0073036 | A1 * | 4/2006 | Pascual et al. | 417/413.1 |
| 2010/0014998 | A1 * | 1/2010 | Conner | 417/413.1 |
| 2010/0021312 | A1 * | 1/2010 | Meza | 417/38 |
| 2010/0101407 | A1 * | 4/2010 | Lynn et al. | 91/505 |

FOREIGN PATENT DOCUMENTS

| | | | |
|---|---|---|---|
| CN | 102032513 | A | 4/2011 |
| EP | 0 743 452 | A1 | 11/1996 |
| EP | 0 936 355 | A2 | 8/1999 |
| EP | 2 306 017 | A1 | 4/2011 |
| JP | 530135759 | | 11/1978 |
| JP | S64-008587 | U | 1/1989 |
| JP | H04-121385 | U | 10/1992 |
| JP | 2004-197571 | A | 7/2004 |
| JP | 2008-008274 | | 1/2008 |
| JP | 2009-293426 | | 12/2009 |
| JP | 2010-161863 | | 7/2010 |

* cited by examiner

DIAPHRAGM PUMP

BACKGROUND OF THE INVENTION

The present invention relates to a diaphragm pump for pressurizing or depressurizing a fluid with respect to, e.g., a sphygmomanometer or home appliance.

As disclosed in Japanese Patent Laid-Open No. 2004-197571, a conventional diaphragm pump includes a motor mounted on the bottom portion of a mounter, a crank axially fixed to the output shaft of the motor, which protrudes into the mounter, a driving shaft having one end portion fixed in an inclined state to a portion of the crank, which is shifted from the output shaft, a driving member including a driving element which has a central portion pivotally supported by the other end portion of the driving shaft and swings as the driving shaft rotates, and a diaphragm having a diaphragm portion that is attached to the driving element of the driving member and forms a pump chamber. In this arrangement, the crank rotates when the motor is driven, and the driving shaft rotates while changing the inclining direction. Consequently, the driving element swings and causes the pump chamber to perform an expanding/contracting operation, thereby performing a pumping action.

In the conventional diaphragm pump as described above, the motor is fixed by screws to the bottom portion of the mounter. Since the screws for fixing are necessary, the number of parts cannot be reduced. Also, it is difficult to automate the mounting work because the motor is mounted on the mounter by screw fastening.

SUMMARY OF THE INVENTION

It is an object of the present invention to provide a diaphragm pump capable of reducing the number of parts.

It is another object of the present invention to provide a diaphragm pump capable of readily introducing automatic assembly when mounting a motor.

To achieve the above objects of the present invention, there is provided a diaphragm pump comprising a motor having a recess in an outer circumferential portion, a crank which rotates together with an output shaft of the motor, a driving member including a driving element which reciprocates in accordance with the rotation of the crank, a diaphragm which forms a pump chamber which expands and contracts in accordance with the reciprocal motion of the driving element of the driving member, a suction passage which draws a fluid into the pump chamber, a discharge passage which discharges the fluid from the pump chamber, a suction valve formed in the suction passage to regulate a reverse flow of the fluid from the pump chamber to the suction passage, a discharge valve formed in the discharge passage to regulate a reverse flow of the fluid from the discharge passage to the pump chamber, and an elastically deformable cylindrical member which holds the diaphragm and includes a projection which engages with the recess of the motor.

In the present invention, a motor can be mounted on a mounter by fitting the motor in the mounter, and engaging a projection with a recess while elastically deforming the mounter. This obviates the need for screws for mounting the motor on the mounter. Also, the motor can be mounted on the mounter by almost linearly moving the motor along the axial direction of the mounter while the motor is fitted in the mounter. This facilitates introducing automatic assembly when mounting the motor.

In addition, the projection engages with the recess when the ceiling portion of the motor abuts against an abutting surface after the motor is fitted in the mounter. This makes mounting of the motor reliable and easy, and also facilitates introducing automated assembly when mounting the motor.

Furthermore, it is possible to use a recess formed simultaneously with the formation of an abutting portion for locking a permanent magnet when attaching the permanent magnet to a yoke. This obviates the need for a new work for forming the recess in the motor.

DESCRIPTION OF THE PREFERRED EMBODIMENTS

Figure 1:
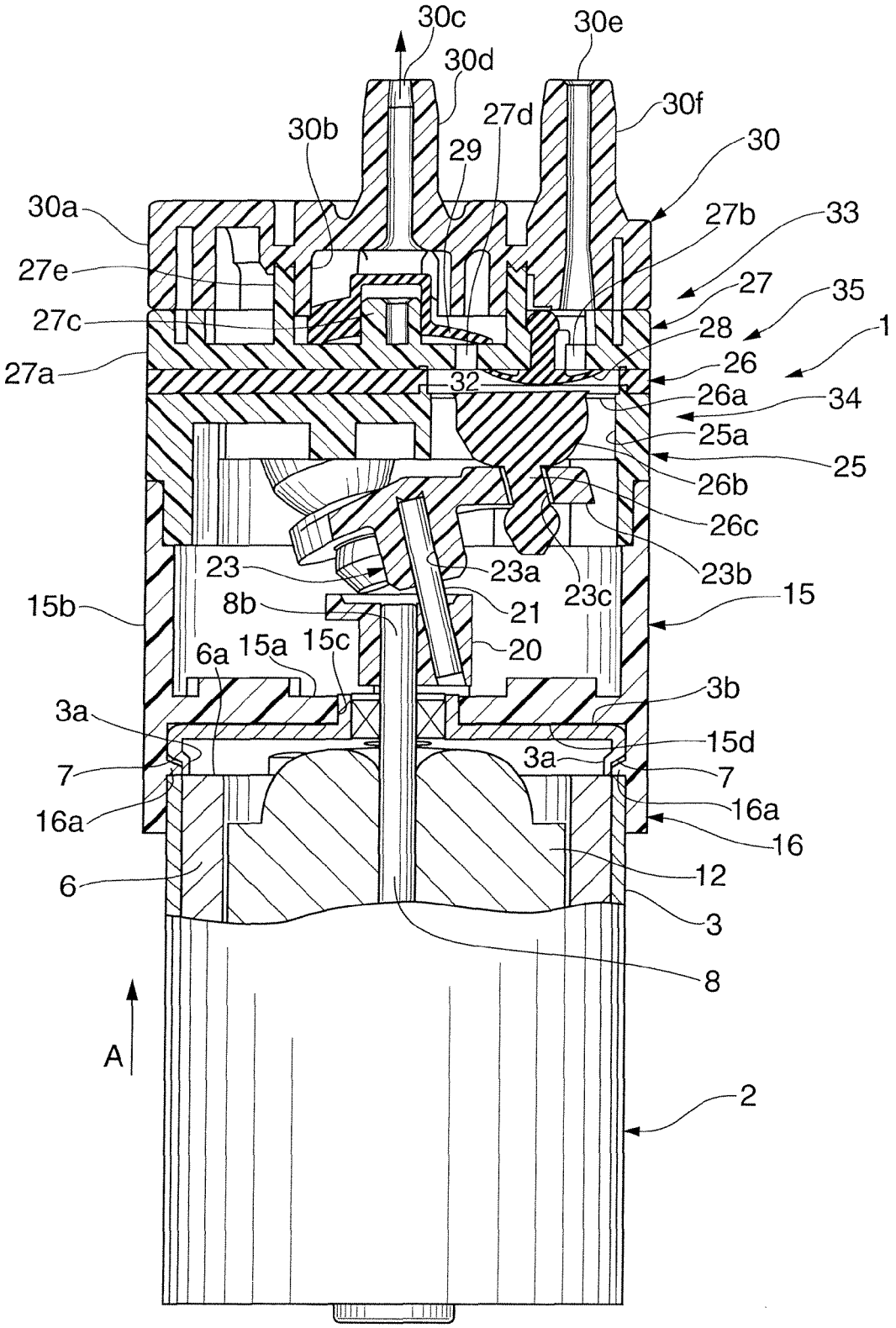
FIG. 1 is a sectional view of a diaphragm pump according to the first embodiment of the present invention.

The present invention will be explained in detail below with reference to the accompanying drawings. Note that "upper" and "lower" used to explain directions in this specification indicate directions in the drawings for the convenience of explanation, and do not necessarily match "upper" and "lower" when actually using a diaphragm pump according to the present invention.

First Embodiment

Figure 2:
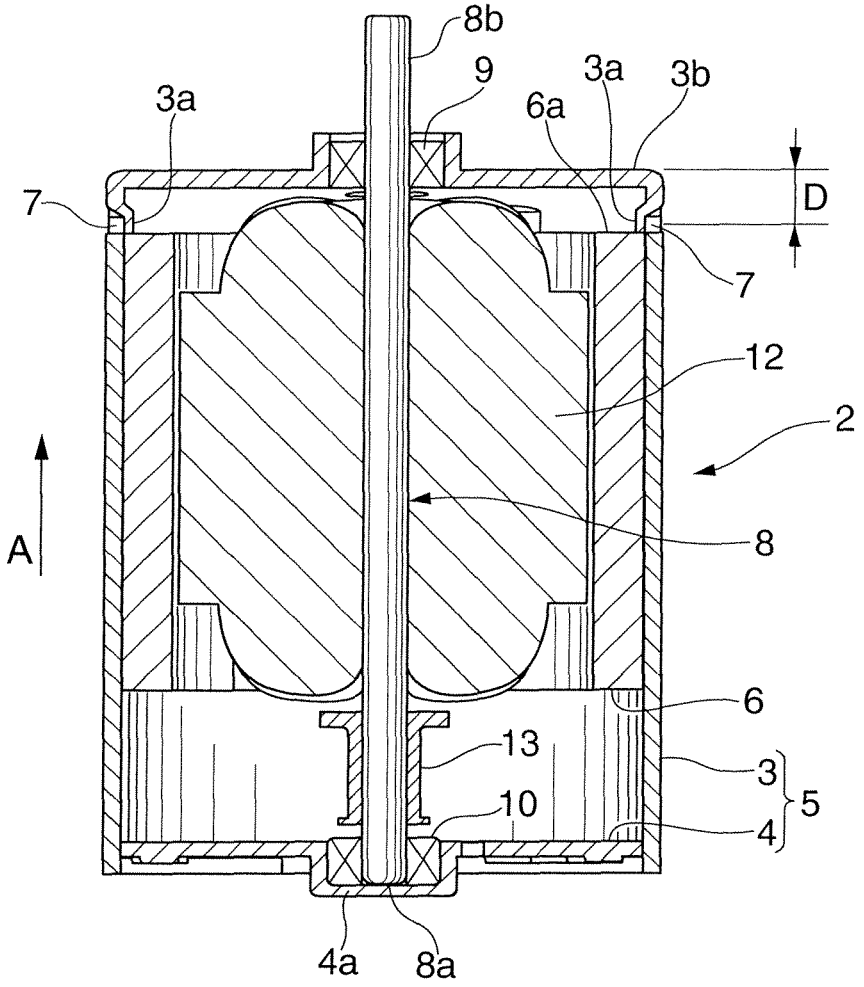
FIG. 2 is an enlarged sectional view of a motor shown in FIG. 1.

First, the first embodiment of the present invention will be explained with reference to FIGS. 1 to 3B. As shown in FIG. 1, a diaphragm pump 1 according to this embodiment includes a motor 2 as a driving source having a circular planar shape. As shown in FIG. 2, the motor 2 includes a motor housing 5 including a cap-like yoke 3 having an open lower end and a bottom plate 4 for closing the opening of the yoke 3. A plurality of recesses 7 are formed in the circumferential direction in the outer circumferential surface of the upper portion of the cylinder of the yoke 3, at the same time an abutting portion 3*a* is formed toward the inside of the yoke 3 by indenting. The plurality of recesses 7 are formed in the same position in the direction of an arrow A (in the direction of the height in the drawings). A permanent magnet 6 is attached to the inner circumferential surface of the yoke 3. The permanent magnetic 6 is pressed in the yoke 3 from below, and attached to a predetermined position of the yoke 3 when the abutting portion 3*a* locks an upper end face 6*a*.

An output shaft 8 is rotatably supported by a bearing 9 fixed to an opening formed in the center of the ceiling of the yoke 3, and a bearing 10 fixed to the center of the bottom plate 4. A thrust receiver 4*a* for closing the bearing hole of the bearing 10 and locking a non-driving end 8*a* of the output shaft 8 is formed in the center of the bottom plate 4, and a driving end portion 8*b* of the output shaft 8 projects upward from the bearing 9. A rotor 12 facing the permanent magnet 6 at a predetermined distance is axially fixed to the central portion of the output shaft 8, and a rectifier 13 is axially fixed below the rotor 12.

In FIG. 1, reference numeral 15 denotes a mounter formed by a resin into an almost closed-bottom cylindrical shape having an open upper end and including a bottom portion 15*a* and cylindrical portion 15*b*. A shaft hole 15*c* is formed in the center of the bottom portion 15*a*. As shown FIG. 3A, the mounter 15 is integrated with a cylindrical motor holder 16 extended from the bottom portion 15*a* to the opposite side, having the same diameter as that of the cylindrical portion 15*b*, and having an open lower end.

The inner diameter of the motor holder 16 is made slightly larger than the outer diameter of the motor 2. On the inner circumferential surface of the motor holder 16, a plurality of projections 16*a* with which the recesses 7 of the motor 2 described above engage are formed in the direction of the center (the radial direction) of the motor holder 16. When the motor 2 is fitted in as will be described later, the motor holder 16 elastically deforms when the recesses 7 engage with the projections 16*a*.

A distance D (see FIG. 3A) between the projection 16*a* and a lower surface 15*d* as the abutting surface of the bottom portion 15*a* is set equal to a distance D (see FIG. 2) between the recess 7 and a ceiling portion 3*b* of the yoke 3 of the motor 2. As will be described later, therefore, when the motor 2 is fitted in the motor holder 16 and the ceiling portion 3*b* of the motor 2 abuts against the lower surface 15*d* of the bottom portion 15*a* of the mounter 15 (the ceiling surface of the motor holder 16), the recesses 7 of the motor 2 engage with the projections 16*a* of the motor holder 16.

Figure 3A:
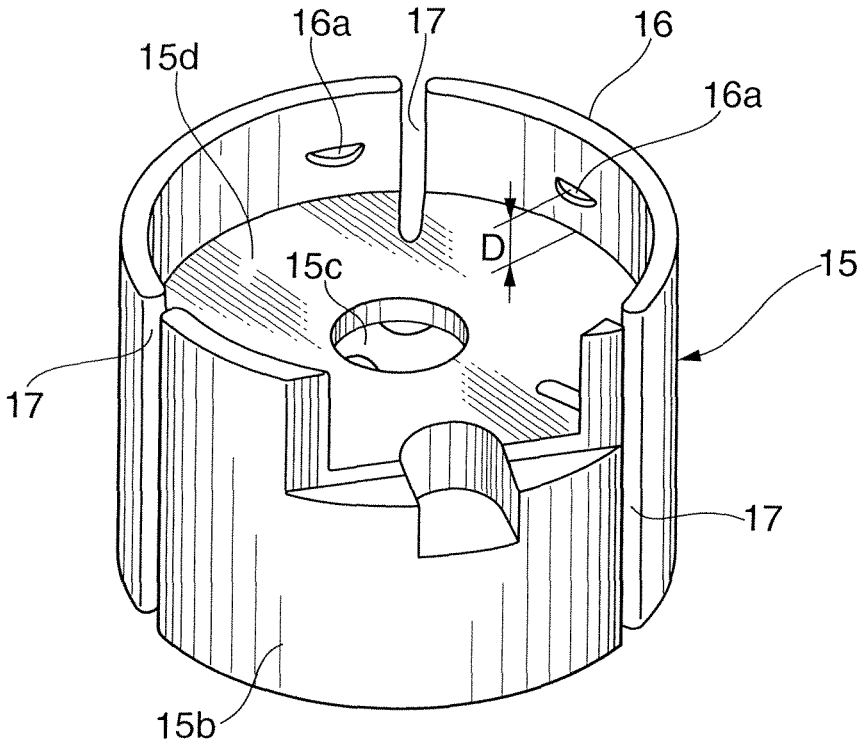
FIG. 3A is a perspective view of a mounter viewed from the bottom surface side in FIG. 1.
Figure 3B:
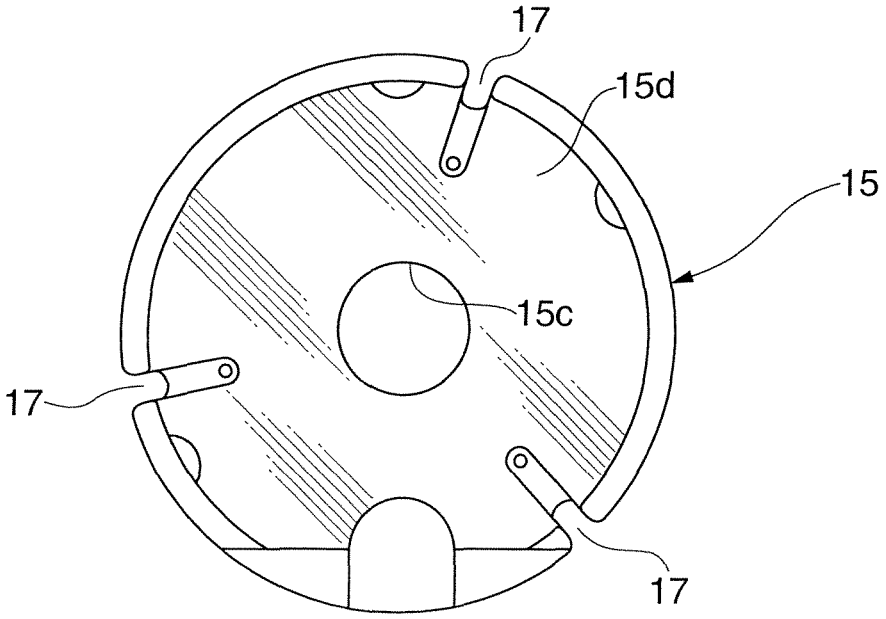
FIG. 3B is a bottom view of the mounter shown in FIG. 1.

As shown in FIGS. 3A and 3B, three grooves 17 vertically extending at an equal angle (120°) in the circumferential direction are formed in the cylindrical portion 15*b* of the mounter 15 so as to extend to the motor holder 16. Since the three grooves 17 divide the motor holder 16 into tree portions in the circumferential direction, the motor holder 16 readily elastically deforms when the recesses 7 engage with the projections 16*a*.

In FIG. 1, reference numeral 20 denotes a crank formed into an almost columnar shape. The driving end portion 8*b* of the output shaft 8 of the motor 2 is fixed to the central portion of the crank 20, so the crank 20 rotates together with the output shaft 8. A driving shaft 21 includes a lower end portion attached in an inclined state to a portion off-centered from the portion of the crank 20 to which the driving end portion 8*b* is attached.

Reference numeral 23 denotes a driving member having a non-through hole 23*a* in the center. Three driving elements 23*b* (two driving elements 23*b* are not shown) projecting in a direction perpendicular to the non-through hole 23*a* are formed integrally with the upper end portion of the driving member 23 at an equal angle (120°) in the circumferential direction in a plane. The driving elements 23*b* are slightly inclined downward at the same angle toward swinging end portions, and each swinging end portion has a diaphragm mounting hole 23*c*.

The driving member 23 is rotatably supported by the driving shaft 21 by inserting the upper portion of the driving shaft 21 into the non-through hole 23*a*. When the crank 20 is rotated by driving the motor 2, the driving shaft 21 rotates while changing the inclining direction, and the swinging end portions of the three driving elements 23*b* sequentially vertically swing via the driving shaft 21.

Reference numeral 25 denotes a diaphragm holder formed into an inverse closed-bottom cylindrical shape. Three holding cylinders 25*a* formed into a cylindrical shape are formed integrally with the ceiling portion of the diaphragm holder 25 at an equal angle (120°) in the circumferential direction.

Reference numeral 26 denotes a diaphragm formed into an almost disc shape by a flexible material such as rubber. Three thin-wall diaphragm portions 26*a* are formed at an equal angle (120°) in the circumferential direction. A piston portion 26*b* is formed integrally with the lower portion of each diaphragm portion 26*a*, and a small-diameter portion 26*c* is formed integrally with the lower end of the piston portion 26*b*.

Reference numeral 27 denotes a valve holder formed into an almost disc shape. A cylindrical portion 27*a* integrally stands on the outer periphery of the valve holder 27, and three suction holes 27*b* (two suction holes 27*b* are not shown) as suction passages are formed in the inner periphery of the cylindrical portion 27*a* at an equal angle (120°) in the circumferential direction. An engaging projecting portion 27*c* integrally stands on the central portion of the valve holder 27. Around the engaging projecting portion 27*c*, three discharge holes 27*d* (two discharge holes 27*d* are not shown) as discharge passages are formed at an equal angle (120°) in the circumferential direction, and a partition wall 27*e* concentrically stands integrally with the cylindrical portion 27*a*.

In FIG. 1, reference numeral 28 denotes an umbrella-shaped suction valve for opening and closing the suction hole 27*b*. The suction valve 28 regulates the reverse flow of a fluid from a pump chamber 32 (to be described later) to the suction hole 27*b*. Reference numeral 29 denotes a hat-shaped discharge valve that is attached to the engaging projecting portion 27*c* and opens and closes the discharge hole 27*d*. The discharge valve 29 regulates the reverse flow of a fluid from a discharge port 30*c* (to be described later) to the pump chamber 32.

Reference numeral 30 denotes a lid formed into an inverse closed-bottom cylindrical shape. A cylindrical portion 30*a* integrally projects downward from the outer periphery, and a partition wall 30*b* having a ring-like planar shape concentric with the cylindrical portion 30*a* integrally projects downward from the central portion. A discharge cylindrical portion 30*d* having the discharge port 30*c* integrally stands from the central portion of the ceiling portion of the lid 30. A suction cylindrical portion 30*f* having a suction port 30*e* integrally stands on a portion of the periphery of the ceiling portion.

Next, a method of assembling the diaphragm pump arranged as described above will be explained. Referring to FIG. 1, the suction valve 28 is attached to the valve holder 27, the discharge valve 29 is attached to the engaging projecting portion 27*c*, and the lid 30 is overlaid on the valve holder 27 and closed by, e.g., welding, thereby forming a valve holder assembly 33. In this state, the cylindrical portions 27*a* and 30*a* oppose each other, the partition walls 27*e* and 30*b* are in contact with each other, the suction hole 27*b* and suction port 30*e* communicate with each other, and the discharge hole 27*d* and discharge port 30*c* communicate with each other.

Then, the motor 2 is fitted in the motor holder 16 of the mounter 15, and pressed in so as to move in the axial direction (the direction of the arrow A) of the mounter 15. When the ceiling portion 3*b* as the end face of the motor 2, which opposes the driving end portion 8*b* is abutted against the lower surface 15*d* of the bottom portion 15*a* of the mounter 15 (the ceiling surface of the motor holder 16) while the motor holder 16 is elastically deformed, the recesses 7 of the motor 2 engage with the projections 16*a* of the motor holder 16. With this engagement, the motor 2 is mounted on the bottom portion 15*a* of the mounter 15, such that the driving end portion 8*b* of the output shaft 8 protrudes into the mounter 15 from the shaft hole 15*c*. Subsequently, the lower end portion of the driving shaft 21 is fixed to the crank 20, and the crank 20 is axially fixed to the driving end portion 8*b* of the output shaft 8.

Thus, conventionally necessary screws are unnecessary to mount the motor 2 on the bottom portion 15*a* of the mounter 15. Also, while the motor 2 is fitted in the motor holder 16 of the mounter 15, the motor 2 can be mounted on the mounter 15 by almost linearly moving the motor 2 along the axial direction of the mounter 15. This facilitates introducing automatic assembly when mounting the motor 2. In addition, since the recesses 7 for forming the abutting portion 3*a* for locking the permanent magnetic 6 in a predetermined position when pressing the permanent magnet 6 in the yoke 3 are used, it is unnecessary to newly form the recesses 7 in the motor 2.

Furthermore, when attaching the motor 2 to the motor holder 16, the projections 16*a* of the motor holder 16 engage with the recesses 7 of the motor 2 when the ceiling portion 3*b* of the motor 2 is abutted against the lower surface 15*d* of the bottom portion 15*a* of the mounter 15. This improves the workability because it is possible to reliably and easily engage the projections 16*a* of the motor holder 16 with the recesses 7 of the motor 2, and facilitates introducing automatic assembly when mounting the motor 2.

Then, the diaphragm 26 is placed on the diaphragm holder 25 by inserting the diaphragm portions 26*a* of the diaphragm 26 into the holding cylinders 25*a* of the diaphragm holder 25, respectively. In this state, the driving member 23 and diaphragm 26 are assembled with the diaphragm holder 25 by inserting the small-diameter portion 26*c* of each piston portion 26*b* into the mounting hole 23*c* of each driving element 23*b* of the driving member 23, thereby forming a diaphragm holder assembly 34.

A pump assembly 35 is formed by overlaying the valve holder assembly 33 on the diaphragm holder assembly 34. In this state, the valve holder 27 and the diaphragm portions 26*a* of the diaphragm 26 form three pump chambers 32 (two pump chambers 32 are not shown), and the three sets of the discharge holes 27*d* and suction holes 27*b* of the valve holder 27 respectively correspond to the pump chambers 32. After that, the pump assembly 35 is moved down from above the mounter 15 and placed on the mounter 15 while the upper portion of the driving shaft 21 is inserted into the non-through hole 23*a* of the driving member 23.

In this state, the pump assembly 35 and mounter 15 are integrated by springs (not shown) inserted into the grooves 17 of the mounter 15, thereby integrally stacking the mounter 15, diaphragm holder 25, diaphragm 26, valve holder 27, and lid 30, and forming the diaphragm pump 1. Thus, the mounter 15 and diaphragm holder 25 are integrally connected.

The pumping action of the diaphragm pump 1 arranged as described above will now be explained. When the crank 20 is rotated via the output shaft 8 by driving the motor 2, the swinging end portions of the three driving elements 23*b* of the driving member 23 sequentially swing in the vertical direction. When the swinging end portion of the first driving element 23*b* moves down, the first pump chamber 32 expands via the piston portion 26*b*, so the internal air of the pump chamber 32 is set at a negative pressure.

Accordingly, the suction valve 28 releases the closure of the suction hole 27*b*, thereby opening the suction hole 27*b*. In this state, air drawn in from the external atmosphere through the suction port 30*e* of the lid 30 flows into the first pump chamber 32.

When the swinging end portion of the driving element 23*b* of the expanded first pump chamber 32 moves up after that, the first pump chamber 32 contracts, so the internal air pressure of the first pump chamber 32 rises. Therefore, the discharge valve 29 releases the closure of the discharge hole 27*d*, thereby opening the discharge hole 27*d*. Consequently, the air in the first pump chamber 32 is discharged from the discharge hole 27*d* through the discharge port 30*c*, and supplied to a pressurization target (not shown) connected to, e.g., an air tube (not shown).

Then, when the crank 20 rotates via the output shaft 8 and the swinging end portion of the second driving element 23*b* moves down, the second pump chamber 32 expands, so the internal air of the pump chamber 32 is set at a negative pressure. Therefore, air drawn in from the external atmosphere through the suction port 30*e* of the lid 30 flows into the expanded second pump chamber 32.

When the swinging end portion of the driving element 23*b* of the expanded second pump chamber 32 moves up after that, the pump chamber 32 contracts, so the internal air pressure of the pump chamber 32 rises. Accordingly, the discharge valve 29 releases the closure of the discharge hole 27*d*, thereby opening the discharge hole 27*d*. Consequently, the internal air of the second pump chamber 32 is discharged from the discharge hole 27*d* through the discharge port 30*c*, and supplied to the pressurization target connected to the air tube or the like.

Furthermore, when the crank 20 rotates via the output shaft 8 and the swinging end portion of the third driving element 23*b* moves down, the third pump chamber 32 expands, so the internal air of the pump chamber 32 is set at a negative pressure. Therefore, air drawn in from the external atmosphere through the suction port 30*e* of the lid 30 flows into the expanded third pump chamber 32.

When the swinging end portion of the driving element 23*b* of the expanded third pump chamber 32 moves up after that, the pump chamber 32 contracts, so the internal air pressure of the pump chamber 32 rises. Accordingly, the discharge valve 29 releases the closure of the discharge hole 27*d*, thereby opening the discharge hole 27*d*. As a consequence, the internal air of the third pump chamber 32 is discharged from the discharge hole 27 through the discharge port 30*c*, and supplied to the pressurization target connected to the air tube or the like. Since the three pump chambers 32 thus sequentially perform the expanding/contracting operation, air having little pulsatile flow is continuously supplied from the discharge port 30*c* to the pressurization target.

Second Embodiment

Figure 4:
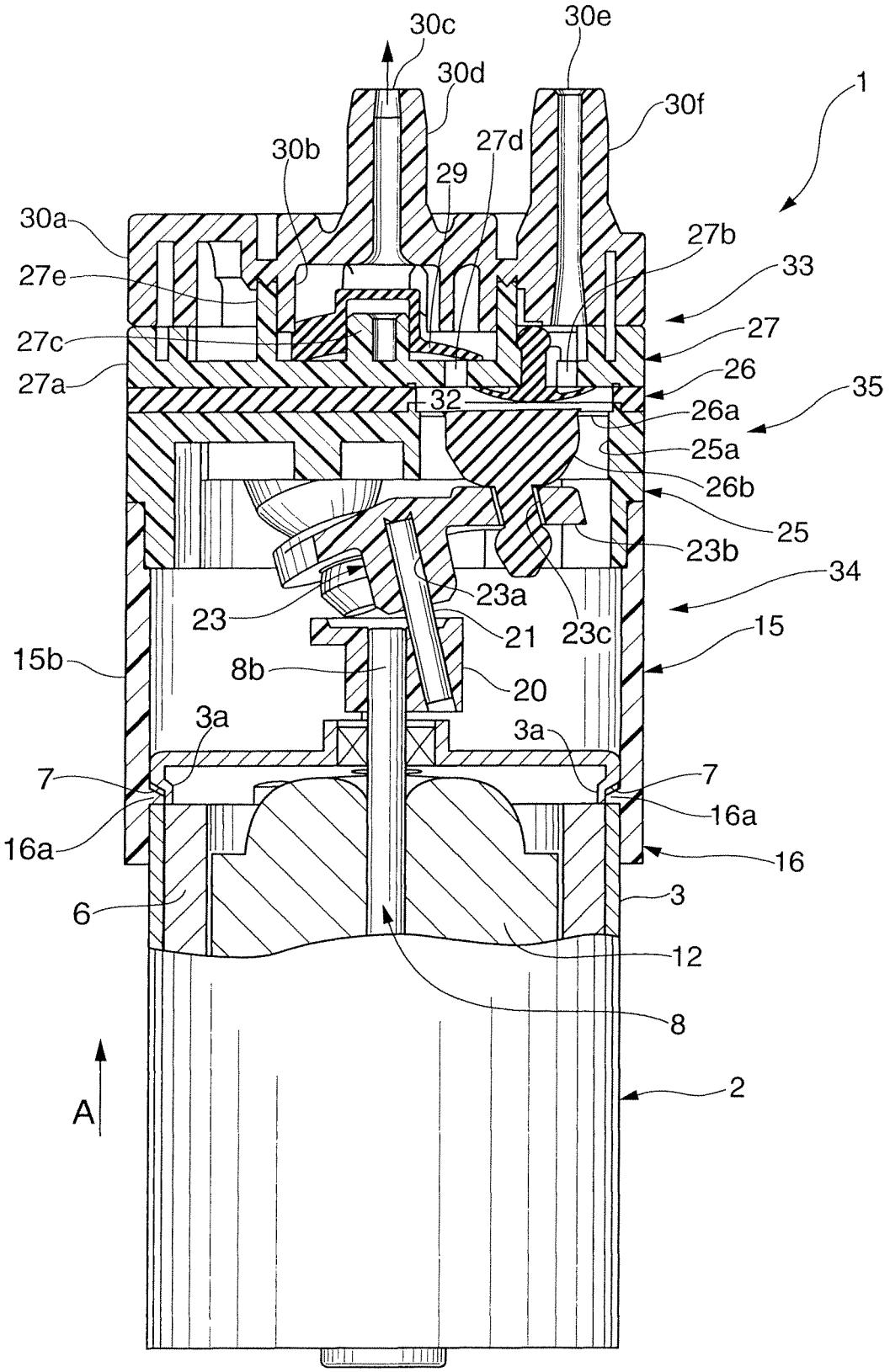
FIG. 4 is a sectional view of a diaphragm pump according to the second embodiment of the present invention.

The second embodiment of the present invention will be explained below with reference to FIG. 4. The second embodiment differs from the above-described first embodiment in that a mounter 15 has no bottom portion 15*a* and has a cylindrical shape having open upper and lower ends. When mounting a motor 2 on the mounter 15 in this arrangement, the motor 2 is fitted in the mounter 15 from below in the same manner as in the first embodiment.

Then, the motor 2 is pressed in as it is moved in the direction of an arrow A. Consequently, recesses 7 of the motor 2 engage with projections 16*a* of the mounter 15 while the mounter 15 elastically deforms, thereby mounting the motor 2 on the mounter 15. In the second embodiment, as in the first embodiment described above, no screws are necessary to mount the motor 2 on the mounter 15, and the motor 2 can be mounted on the mounter 15 by only almost linearly moving the motor 2 in the direction of the arrow A. This facilitates introducing automated assembly when mounting the motor 2.

Third Embodiment

Figure 6:
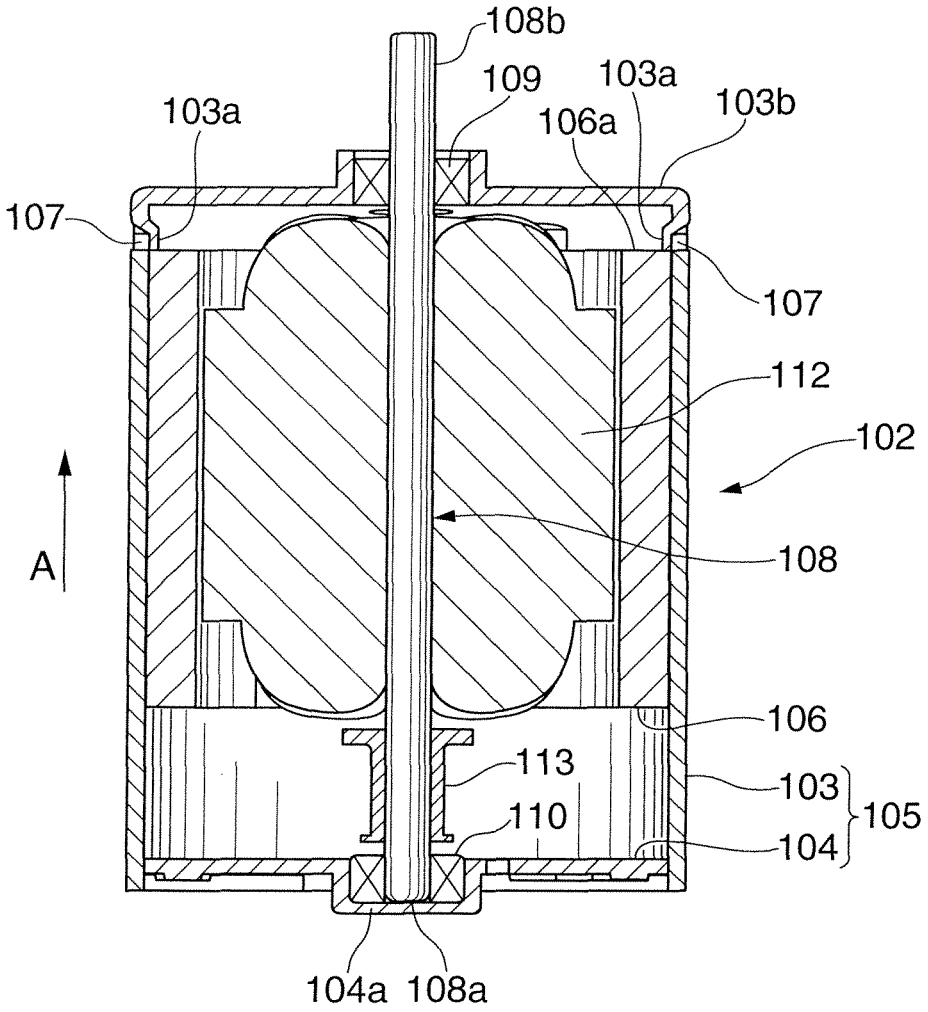
FIG. 6 is a sectional view of a motor shown in FIG. 5.
Figure 7:
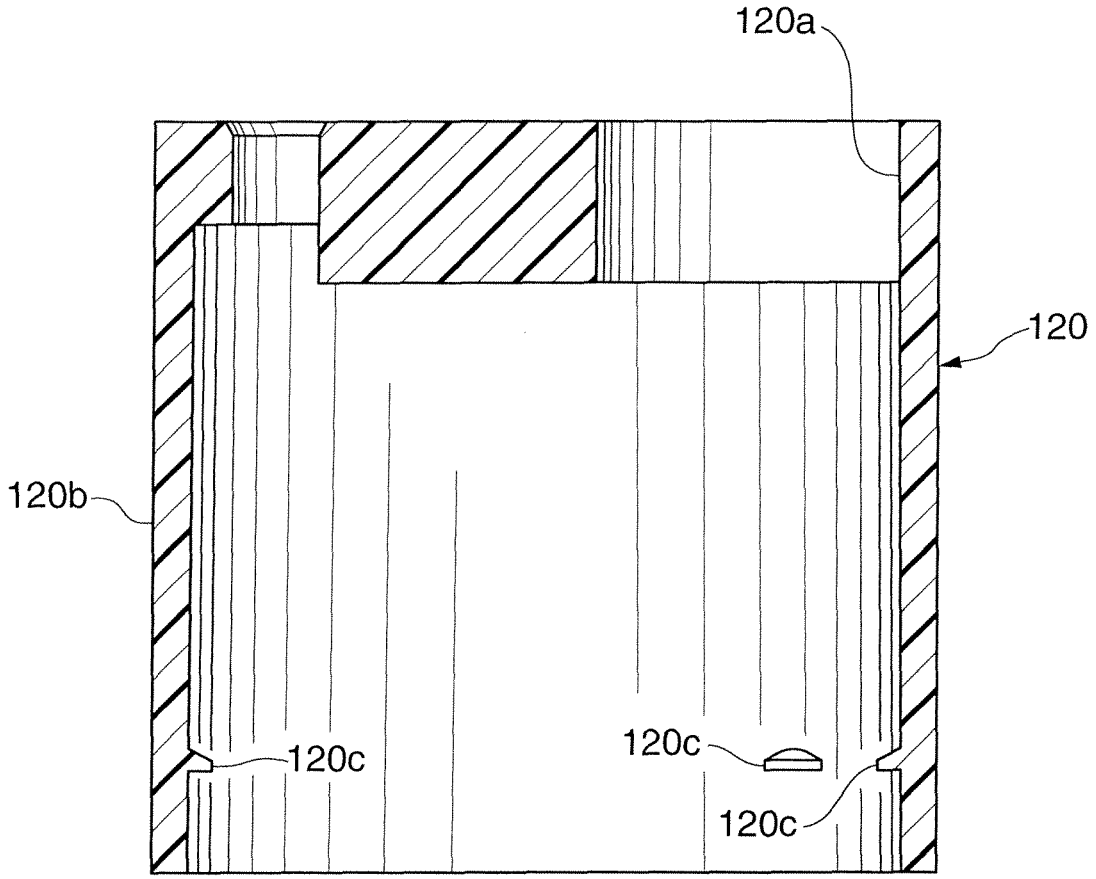
FIG. 7 is a sectional view of a diaphragm holder shown in FIG. 5.

The third embodiment of the present invention will be explained below with reference to FIGS. 5 to 7. Note that an explanation of the same portions as in the first embodiment will be omitted.

Figure 5:
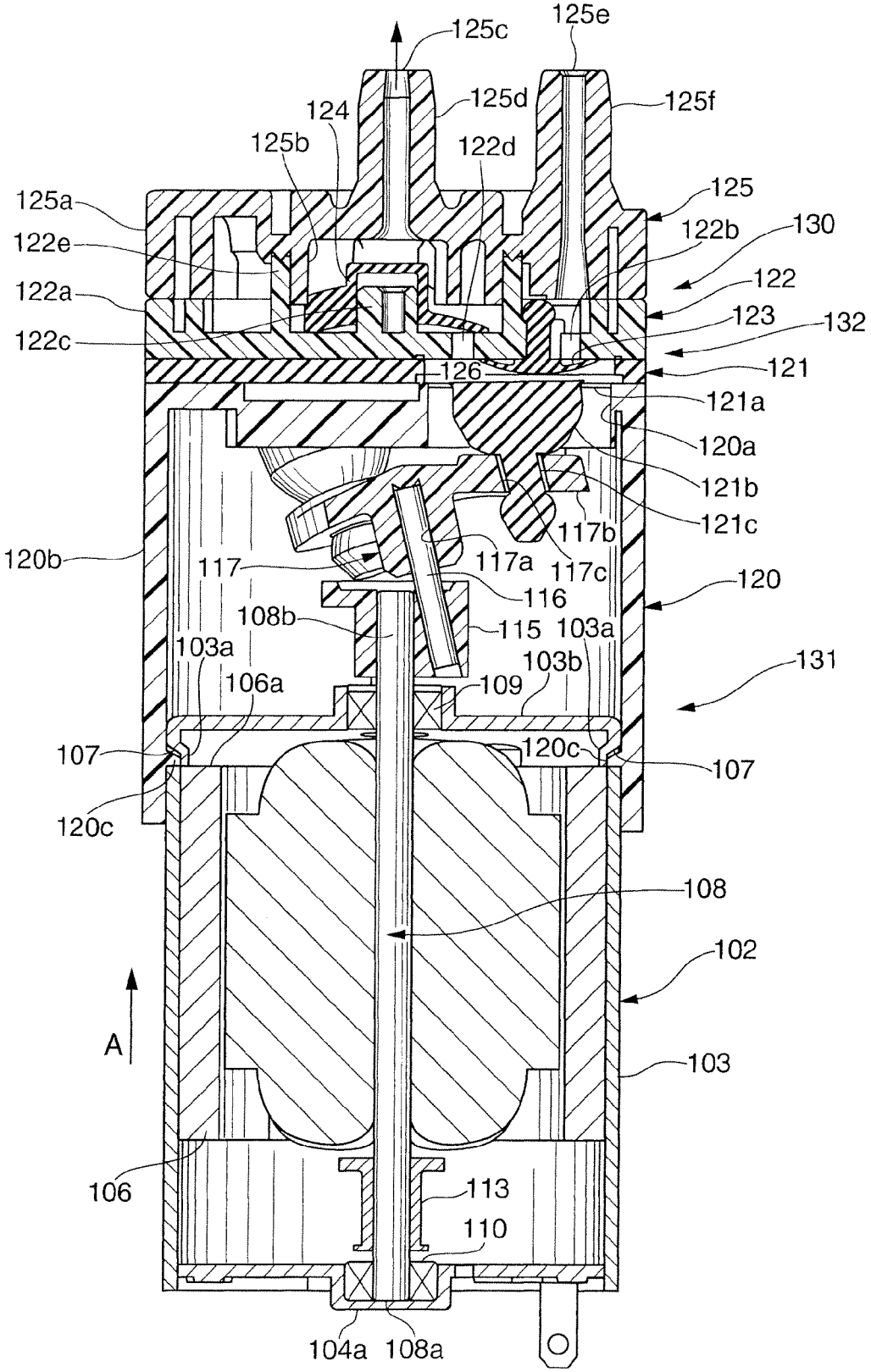
FIG. 5 is a sectional view of a diaphragm pump according to the third embodiment of the present invention.

In FIG. 5, reference numeral 115 denotes a crank formed into an almost columnar shape. A driving end portion 108*b* of an output shaft 108 of a motor 102 is fixed to the central portion of the crank 115, so the crank 115 rotates together with the output shaft 108. A driving shaft 116 has a lower end portion attached in an inclined state to a portion off-centered from the portion of the crank 115 to which the driving end portion 108*b* is attached.

Reference numeral 117 denotes a driving member having a non-through hole 117*a* in the center. Three driving elements 117*b* (two driving elements 117*b* are not shown) projecting in a direction perpendicular to the non-through hole 117*a* are formed integrally with the upper end portion of the driving member 117 at an equal angle (120°) in the circumferential direction in a plane. The driving elements 117*b* are slightly inclined downward at the same angle toward swinging end portions, and each swinging end portion has a diaphragm mounting hole 117*c*.

The driving member 117 is rotatably supported by the driving shaft 116 by inserting the upper portion of the driving shaft 116 into the non-through hole 117*a*. When the crank 115 is rotated by driving the motor 102, the driving shaft 116 rotates while changing the inclining direction, and the swinging end portions of the three driving elements 117*b* sequentially vertically swing via the driving shaft 116.

Reference numeral 120 denotes a diaphragm holder formed into an inverse closed-bottom cylindrical shape having an open lower end by using a resin. As shown in FIG. 7, three holding cylinders 120*a* (two holding cylinders 120*a* are not shown) formed into a cylindrical shape are formed integrally with the ceiling portion of the diaphragm holder 120 at an equal angle (120°) in the circumferential direction. The inner diameter of the cylindrical portion 120*b* of the diaphragm holder 120 is made slightly larger than the outer diameter of the motor 102.

On the inner circumferential surface of the lower portion of the cylindrical portion 120*b* of the diaphragm holder 120, a plurality of projections 120*c* that engage with recesses 107 of the motor 102 described above project in the direction of the center (the radial direction) of the diameter of the cylindrical portion 120*b*. The diaphragm holder 120 elastically deforms when the motor 102 is fitted in and the recesses 7 engage with the projections 120*c*.

In FIG. 5, reference numeral 121 denotes a diaphragm formed into an almost disc shape by a flexible material such as rubber. Three thin-wall diaphragm portions 121*a* are formed at an equal angle (120°) in the circumferential direction. A piston portion 121*b* is formed integrally with the lower portion of the diaphragm portion 121*a* (two diaphragm portions 121*a* are not shown), and a small-diameter portion 121*c* is formed integrally with the lower end of the piston portion 121*b*.

Reference numeral 122 denotes a valve holder formed into an almost disc shape. A cylindrical portion 122*a* integrally stands on the outer periphery of the valve holder 122, and three suction holes 122*b* (two suction holes 122*b* are not shown) as suction passages are formed in the inner periphery of the cylindrical portion 122*a* at an equal angle (120°) in the circumferential direction. An engaging projecting portion 122*c* integrally stands on the central portion of the valve holder 122. Around the engaging projecting portion 122*c*, three discharge holes 122*d* (two discharge holes 122*d* are not shown) as discharge passages are formed at an equal angle (120°) in the circumferential direction, and a partition wall 122*e* concentrically stands integrally with the cylindrical portion 122*a*.

Reference numeral 123 denotes an umbrella-shaped suction valve that is attached to the valve holder 122 and opens and closes the suction hole 122*b*. The suction valve 123 regulates the reverse flow of a fluid from a pump chamber 126 (to be described later) to the suction hole 122*b*. Reference numeral 124 denotes a hat-shaped discharge valve that is attached to the engaging projecting portion 122*c* and opens and closes the discharge hole 122*d*. The discharge valve 124 regulates the reverse flow of a fluid from a discharge port 125*c* (to be described later) to the pump chamber 126.

Reference numeral 125 denotes a lid formed into an inverse closed-bottom cylindrical shape. A cylindrical portion 125*a* integrally projects downward from the outer periphery, and a partition wall 125*b* having a ring-like planar shape concentric with the cylindrical portion 125*a* integrally projects downward from the central portion. A discharge cylindrical portion 125*d* having the discharge port 125*c* integrally stands on the central portion of the ceiling portion of the lid 125. A suction cylindrical portion 125*f* having a suction port 125*e* integrally stands on a portion of the periphery of the ceiling portion.

Next, a method of assembling the diaphragm pump arranged as described above will be explained. Referring to FIG. 5, the suction valve 123 is attached to the valve holder 122, the discharge valve 124 is attached to the engaging projecting portion 122*c*, and the lid 125 is overlaid on the valve holder 122 and closed by, e.g., welding, thereby forming a valve holder assembly 130. In this state, the cylindrical portions 122*a* and 125*a* oppose each other, the partition walls 122*e* and 125*b* are in contact with each other, the suction hole 122*b* and suction port 125*e* communicate with each other, and the discharge hole 122*d* and discharge port 125*c* communicate with each other.

Then, the diaphragm holder 121 is placed on the diaphragm holder 120 by inserting each diaphragm portion 121*a* of the diaphragm 121 into the holding cylinder 120*a* of the diaphragm holder 120. In this state, the driving member 117 and diaphragm 121 are assembled with the diaphragm holder 120 by inserting the small-diameter portion 121*c* of each piston portion 121*b* into the mounting hole 117*c* of each driving element 117*b* of the driving member 117.

Subsequently, the lower portion of the driving shaft 116 is fixed to the crank 115, and the crank 115 is axially fixed to the driving end portion 108*b* of the output shaft 108 of the motor 102. In this state, the motor 102 is fitted in the diaphragm holder 120 from below, and pressed in as it is moved in the axial direction (the direction of the arrow A) of the diaphragm holder 120, thereby engaging the recesses 107 of the motor 102 with the projections 120*c* of the diaphragm holder 120 while elastically deforming the diaphragm holder 120. With this engagement, the motor 102 is attached to the diaphragm holder 120 such that the crank 115 protrudes into the diaphragm holder 120. At the same time, a diaphragm holder assembly 131 is formed by inserting the upper portion of the driving shaft 116 into the non-through hole 117*a* of the driving member 117.

A pump assembly 132 is formed by overlaying the valve holder assembly 130 on the diaphragm holder assembly 131, and a diaphragm pump 101 is formed by stacking the diaphragm holder 120, diaphragm 121, valve holder 122, and lid 125 and integrating them by using springs (not shown). In this state, the valve holder 122 and the diaphragm portions 121*a* of the diaphragm 121 form three pump chambers 126 (two pump chambers 126 are not shown), and the three discharge holes 122*d* and three suction holes 122*b* of the valve holder 122 respectively correspond to the three pump chambers 126.

Thus, conventionally necessary screws are unnecessary to attach the motor 102 to the diaphragm holder 120, and a mounter for mounting the motor 102 is also unnecessary, so the number of parts reduces. In addition, while the motor 102 is fitted in the diaphragm holder 120, the motor 102 can be attached to the diaphragm holder 120 by almost linearly moving the motor 102 along the axial direction of the diaphragm holder 120. This facilitates introducing automatic assembly when assembling the motor 102. Furthermore, since the recesses 107 for forming the abutting portion 103*a* for locking a permanent magnetic 106 when attaching the permanent magnet 106 to a yoke 103 are used, it is unnecessary to newly form recesses in the motor 102.

The pumping action of the diaphragm pump 101 arranged as described above will now be explained. When the crank 115 is rotated via the output shaft 108 by driving the motor 102, the swinging end portions of the three driving elements 117*b* of the driving member 117 sequentially swing in the vertical direction. When the swinging end portion of the first driving element 117*b* moves down, the first pump chamber 126 expands via the piston portion 121*b*, so the internal air of the pump chamber 126 is set at a negative pressure.

Accordingly, the suction valve 123 releases the closure of the suction hole 122*b*, thereby opening the suction hole 122*b*. In this state, air drawn in from the external atmosphere through the suction port 125*e* of the lid 125 flows into the first pump chamber 126.

When the swinging end portion of the driving element 117*b* of the expanded first pump chamber 126 moves up after that, the first pump chamber 126 contracts, so the internal air pressure of the first pump chamber 126 rises. Therefore, the discharge valve 124 releases the closure of the discharge hole 122*d*, thereby opening the discharge hole 122*d*. Consequently, the air in the first pump chamber 126 is discharged from the discharge hole 122*d* through the discharge port 125*c*, and supplied to a pressurization target (not shown) connected to, e.g., an air tube (not shown).

Then, when the crank 115 rotates via the output shaft 108 and the swinging end portion of the second driving element 117*b* moves down, the second pump chamber 126 expands, so the internal air of the pump chamber 126 is set at a negative pressure. Therefore, air drawn in from the external atmosphere through the suction port 125*e* of the lid 125 flows into the expanded second pump chamber 126.

When the swinging end portion of the driving element 117*b* of the expanded second pump chamber 126 moves up after that, the pump chamber 126 contracts, so the internal air pressure of the pump chamber 126 rises. Accordingly, the discharge valve 124 releases the closure of the discharge hole 122*d*, thereby opening the discharge hole 122*d*. Consequently, the internal air of the second pump chamber 126 is discharged from the discharge hole 122*d* through the discharge port 125*c*, and supplied to the pressurization target connected to the air tube or the like.

Furthermore, when the crank 115 rotates via the output shaft 108 and the swinging end portion of the third driving element 117*b* moves down, the third pump chamber 126 expands, so the internal air of the pump chamber 126 is set at a negative pressure. Therefore, air drawn in from the external atmosphere through the suction port 125*e* of the lid 125 flows into the expanded third pump chamber 126.

When the swinging end portion of the driving element 117*b* of the expanded third pump chamber 126 moves up after that, the pump chamber 126 contracts, so the internal air pressure of the pump chamber 126 rises. Accordingly, the discharge valve 124 releases the closure of the discharge hole 122*d*, thereby opening the discharge hole 122*d*. As a consequence, the internal air of the third pump chamber 126 is discharged from the discharge hole 122 through the discharge port 125*c*, and supplied to the pressurization target connected to the air tube or the like. Since the three pump chambers 126 thus sequentially perform the expanding/contracting operation, air having little pulsatile flow is continuously supplied from the discharge port 125*c* to the pressurization target.

Fourth Embodiment

Figure 8:
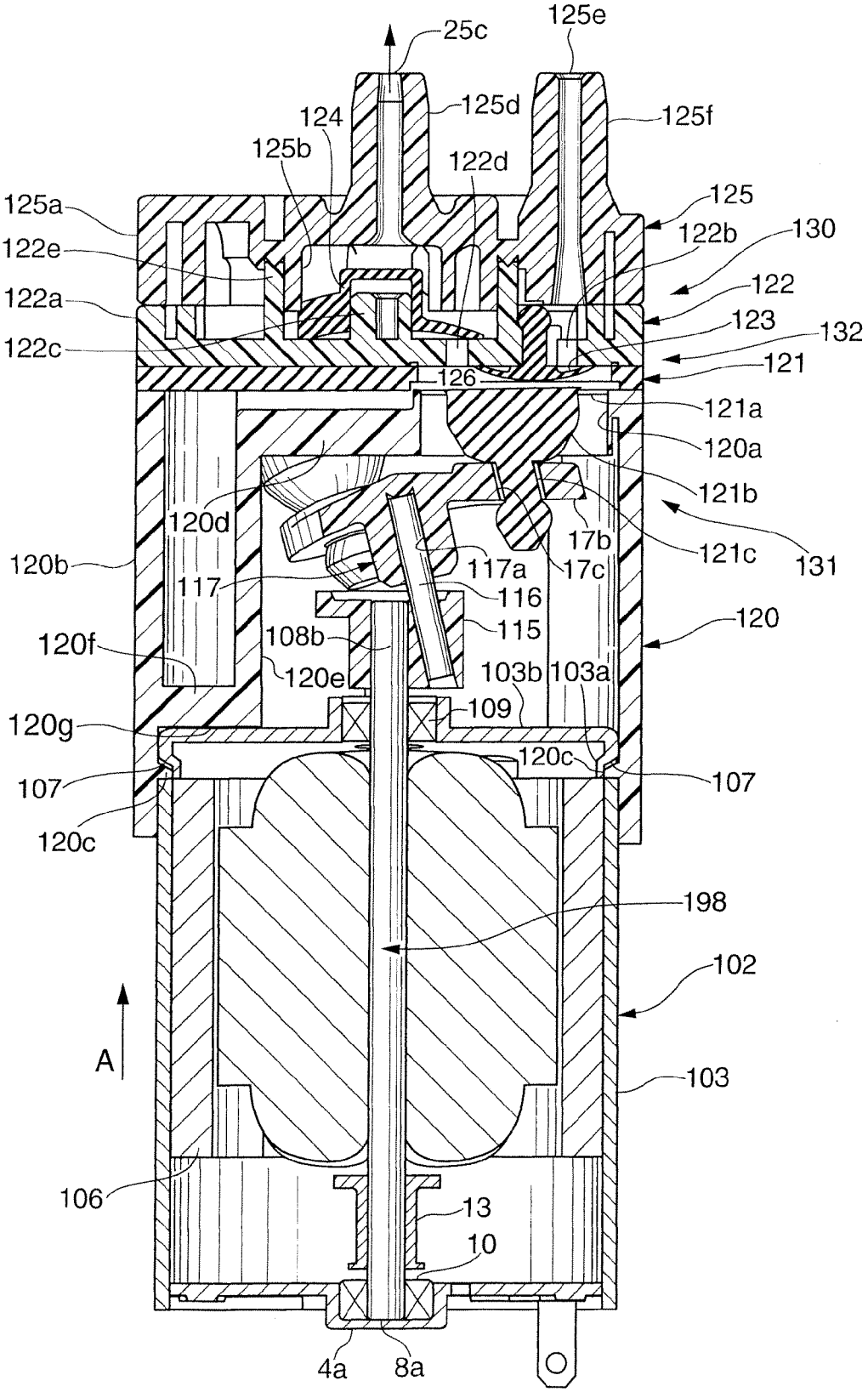
FIG. 8 is a sectional view of a diaphragm pump according to the fourth embodiment of the present invention.

The fourth embodiment of the present invention will be explained below with reference to FIG. 8. The fourth embodiment differs from the third embodiment in that an abutting member 120*e* having a closed-bottom cylindrical shape integrally projects downward from the periphery of a ceiling portion 120*d* of a diaphragm holder 120. The lower surface of a bottom portion 120*f* of the abutting member 120*e* functions as an abutting surface 120*g* against which a ceiling portion 103*b* of a motor 102 abuts, when the motor 102 is fitted in the diaphragm holder 120 from below and pushed as it is moved in the axial direction (the direction of an arrow A) of the diaphragm holder 120, and recesses 107 of the motor 102 are engaged with projections 120*c* of the diaphragm holder 120 while the diaphragm holder 120 is elastically deformed.

Accordingly, when the ceiling portion 103*b* of the motor 102 fitted in the diaphragm holder 120 from below abuts against the abutting surface 120*g*, projections 120*c* of the diaphragm holder 120 engage with the recesses 107 of the motor 102. This improves the reliability and easiness of the work of attaching the motor 102 to the diaphragm holder 120, and facilitates introducing automated assembly in the assembling work.

Note that in each embodiment described above, a so-called, three-cylinder pump including three pump chambers is taken as an example. However, the present invention is of course applicable to a diaphragm pump including two or less cylinders or four or more cylinders. Also, the suction valve and discharge valve are separated from the diaphragm in each embodiment, but they may also be formed integrally with the diaphragm. Furthermore, although the motor holder and mounter are formed into a cylindrical shape in each embodiment, they may also have an elliptical cylindrical shape or square cylindrical shape in accordance with the planar shape of the motor. In short, any shape can be used as long as the motor can be fitted in the motor holder or mounter.

In each embodiment, the recesses formed for forming the abutting portions for locking the permanent magnet when attaching the permanent magnet to the yoke are used as the recesses to be engaged with the projections of the mounter. However, the present invention is not limited to this, and it is of course possible to use other recesses formed in the yoke.

In each embodiment, one end portion of the driving shaft is fixed to the crank, and the other end portion is pivotally supported in the blind hole of the driving member. However, the present invention is not limited to this. For example, it is also possible to pivotally support one end portion of the driving shaft by the crank, and fix the other end portion to the driving member. Alternatively, it is possible to fix the central portion of the driving shaft to the driving member, and pivotally support the upper and lower ends by the diaphragm holder and crank. Furthermore, the driving shaft itself may be integrated with the driving member. That is, various design changes are possible. In short, the pump need only include a driving member including a driving element that reciprocates in accordance with the rotation of the crank, and a diaphragm for forming a pump chamber that expands and contracts in accordance with the reciprocal motion of the driving element.

What is claimed is:

1. A diaphragm pump comprising:

a motor comprising a cylindrical yoke, an output shaft projecting from inside the yoke, and a recess formed in an outer circumferential surface of the yoke and including two side surfaces facing each other;

a crank which rotates together with the output shaft of said motor;

a driving member including a driving element which reciprocates in accordance with the rotation of said crank;

a diaphragm which forms a pump chamber which expands and contracts in accordance with the reciprocal motion of said driving element of said driving member;

a suction passage which draws a fluid into said pump chamber;

a discharge passage which discharges the fluid from said pump chamber;

a suction valve formed in said suction passage to regulate a reverse flow of the fluid from said pump chamber to said suction passage;

a discharge valve formed in said discharge passage to regulate a reverse flow of the fluid from said discharge passage to said pump chamber; and a cylindrical member which holds said diaphragm, includes a first projection which is inserted between the two side surfaces of the recess and engages with the recess of said motor, and is elastically deformable, wherein said motor further comprises a permanent magnet attached to an inner surface of said yoke, and a rotor surrounded by said permanent magnet and axially fixed to the output shaft of said motor, the recess forms an abutting portion which locks said permanent magnet in a predetermined position when said permanent magnet is pressed in said yoke, and the abutting portion is formed by a second projection which projects to an inner side of the yoke by forming said recess on the outer circumferential surface of the yoke.

2. A pump according to claim 1, wherein said cylindrical member comprises:

a cylindrical diaphragm holder which holds said diaphragm; and a mounter integrally connected to a lower portion of said diaphragm holder, and including an elastically deformable motor holder having, on an inner circumferential portion, the first projection to be engaged with the recess of said motor.

3. A pump according to claim 2, wherein said mounter includes an abutting portion against which a ceiling portion of said motor abuts when the recess of said motor engages with the first projection of said motor holder.

4. A pump according to claim 1, wherein said cylindrical member comprises an elastically deformable cylindrical diaphragm holder which holds said diaphragm and has, in a lower portion of an inner circumferential portion, the first projection to be engaged with the recess of said motor.

5. A pump according to claim 4, wherein said diaphragm holder includes an abutting portion against which a ceiling portion of said motor abuts when the recess of said motor engages with the first projection of said diaphragm holder.

* * * * *